United States Patent [19]

Kiger et al.

[11] Patent Number: 4,903,679

[45] Date of Patent: Feb. 27, 1990

[54] DRESSING OF GRINDING WHEELS

[75] Inventors: William E. Kiger, Germantown; Carlos E. Pfaff, King, both of N.C.

[73] Assignee: Westinghouse Electric Corp., Pittsburgh, Pa.

[21] Appl. No.: 257,901

[22] Filed: Oct. 14, 1988

[51] Int. Cl.[4] ..... B24B 53/08

[52] U.S. Cl. ..... 125/11 R; 125/11 TP; 51/325

[58] Field of Search ..... 51/5 D, 325; 125/11 R, 125/11 TP, 11 AT, 11 AS, 11 NT, 11.17, 39

[56] References Cited

U.S. PATENT DOCUMENTS

| | | | |
|---|---|---|---|
| 2,197,762 | 4/1940 | Johnson et al. | 125/11 AT |
| 3,155,086 | 11/1964 | Ornehage | 125/11 TP |
| 4,603,677 | 8/1986 | Gile et al. | 125/11 TP X |
| 4,624,236 | 11/1986 | Gile et al. | 125/11 R |

*Primary Examiner*—Robert P. Olszewski

[57] ABSTRACT

In a method for dressing a grinding wheel (2) by advancing a diamond nib (6) adjacent the outer circumference of the wheel (2) while the wheel (2) rotates about its axis, which method includes causing the diamond nib (6) to execute a plurality of passes in a direction parallel to the axis of wheel (2) rotation while displacing the nib (6) perpendicular to the axis of wheel (2) rotation in a pattern corresponding to the profile to be created at the wheel (2) circumference, which profile includes at least one annular groove having at least one side wall which extends in a given angular direction at an angle of no greater than 20° to a plane perpendicular to the axis of wheel (2) rotation, the wheel (2) is provided with a circumferential portion (14) which will not be used for a subsequent grinding operation and the nib (6) is driven in order to form, on the circumferential portion (14), an inclined surface (16) which extends in the given angular direction at an angle to a plane perpendicular to the axis of wheel (2) rotation which is greater than the angle of the at least one groove wall.

11 Claims, 1 Drawing Sheet

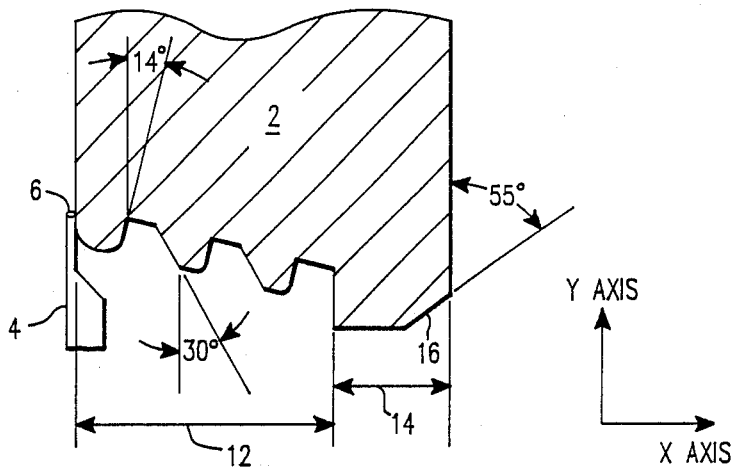
14°
2
6
55°
Y AXIS
4
30°
16
14
12
X AXIS

DRESSING OF GRINDING WHEELS

BACKGROUND OF THE INVENTION

The present invention relates to the dressing of grinding wheels in order to impart a desired profile to the circumferential edge thereof.

For many industrial purposes, there is a need for grinding wheels whose circumferential surfaces are formed to have relatively complex, dimensionally precise profiles. For example, if a grinding wheel is to be employed to grind turbine root serration cutters, a grinding wheel profile composed of a plurality of precisely dimensioned recesses and lands must be created.

It is known to dress such grinding wheels, i.e., to create the desired profile on the grinding wheel circumference, by the use of a numerically controlled grinder which advances a diamond nib along a path corresponding to the desired profile. The nib is caused to execute a large number of passes parallel to the axis of rotation of the grinding wheel while tracing the desired profile as the grinding wheel is rotated about its axis. As the profile is being formed in the outer surface of the grinding wheel, the nib is fed progressively in the radial direction toward the grinding wheel axis. The diamond nib may be in the form of a cylinder whose axis lies in a plane perpendicular to the axis of rotation of the grinding wheel.

It has been found that when this procedure is employed for grinding profiles having certain geometries, inaccuracies occur in the profile being formed and applicants have discovered that this was due to uneven wear experienced by the diamond nib, resulting in the development of a flat spot on one side or the other, accompanied by development of a sharp corner along the portion of the diamond which faces the grinding wheel axis of rotation. This problem appeared to be particularly pronounced when one side of each recess of the grinding wheel profile formed a large angle with the grinding wheel axis of rotation.

SUMMARY OF THE INVENTION

It is an object of the present invention to improve the precision of such grinding wheel dressing operations.

Another object of the invention is to eliminate inaccuracies in the profile being formed in a grinding wheel.

A more specific object of the invention is to promote even wear of a diamond nib during grinding wheel dressing.

A further specific object of the invention is to continuously compensate for uneven wear during a dressing procedure.

BRIEF DESCRIPTION OF THE DRAWING

The sole FIG. is a cross-sectional detail view of the circumferential portion of a grinding wheel which is being dressed in accordance with the present invention.

DESCRIPTION OF THE PREFERRED EMBODIMENTS

The Figure shows the circumferential portion of a grinding wheel 2 which is being dressed, to have the illustrated profile, by a numerically controlled machine having a tool holder 4 provided at its cutting edge with a diamond nib 6. The profile being cut, which will subsequently be used to grind a cutter having a corresponding profile, extends over an axial region 12 of the circumference of grinding wheel 2.

In the illustrated example, the profile being cut in region 12 consists of a succession of annular lands and grooves. Relative to planes perpendicular to the axis of rotation of wheel 2, the left-hand wall of each groove extends at an angle of 14°, the right-hand wall of each groove extends at an angle of 30°, the base of each groove and the top, or crest, of each land extends at an angle of slightly less than 90°, and profile region 12 ends, at the right-hand side, in a wall which forms an angle of the order of 1°.

Grinding wheel 2 is dressed by advancing tool holder 4 together with diamond nib 6 in a selected direction along the X axis, while displacing tool holder 4 parallel to the Y axis, under control of suitable programming, in order to trace the desired profile. At the end of each pass in the direction of the X axis, tool holder 4 can be retracted and returned to the left-hand end of its travel path, or can be caused to effect a pass toward the left, while again tracing the desired profile. During the dressing movements of tool holder 4, wheel 2 is rotated about its axis at a suitable speed. The grinding operation as described thus far is carried out in accordance with principles known in the art.

It has been found that when cutting a profile of the general type shown in the Figure according to prior art techniques, undesired dips and bumps appear in the profile, preventing sufficiently close tolerances to be maintained, and examination of diamond nib 6 revealed that its active surfaces were being worn unevenly, with the resulting change in configuration of nib 6 being most pronounced in that region which contacted the left-hand wall of each profile groove.

While wear was also produced during grinding of the right-hand wall of each profile groove, it was found that the shape of nib 6 was altered less by this wear because of the larger angle subtended by those groove walls and because the grinding of the groove bottoms, land tops and groove corners caused the leading edge of nib 6 to be worn in such a manner that the nib portion which contacted the right-hand groove walls maintained approximately the original circular outline of the nib.

Based on an understanding of the manner in which the nib was being affected by the dressing operation, applicants conceived that greater precision could be introduced into this operation by equalizing the wear experienced along both sides of nib 6 and it was discovered that this could be achieved by using, or establishing, a portion 14 of wheel 2 which would not be used for the subsequent cutter grinding operation and by driving holder 4 so that during each dressing pass, nib 6 would form, on unused portion 14, a surface 16 which would have the effect of compensating for the uneven wear described. It was further discovered that the desired result could be achieved by forming surface 16 to be inclined in the same direction as the groove walls producing the uneven wear and to have a greater inclination to the axis of rotation of wheel 2 than the groove walls which created the uneven nib wear. In the illustrated example, it was found that the best result could be achieved if surface 16 is inclined at an angle of 55° to a plane perpendicular to the axis of rotation of wheel 2. While producing surface 16, the leading portion of the somewhat flatten surface region of nib 6, created by the left-hand groove walls in region 12, is worn in a manner which tends to restore, or maintain, the original circular contour of the nib.

It has been found that when the technique described above is employed, the undesired dips and bumps previously noted are eliminated, or at least significantly reduced, and it becomes possible to maintain dimensional tolerances in region 12 of as small as $\pm 1.25\mu$ ($\pm 0.00005''$).

While an inclination of 55° for surface 16 was found to produce optimum results, it has been further noted that if surface 16 is formed with an inclination of between 30° and 60 ° a noticeable improvement in the performance of nib 6 will be produced.

It has further been found that the present invention is applicable to grinding operations in which one wall of each groove, or at least of some of the grooves, of the profile being formed extends at an angle of 1°-20° to a plane perpendicular to the axis of wheel 2. Tests conducted thus far indicate that the optimum inclination of surface 16 will vary as a direct function of the inclination of the groove wall surface, or surfaces, that tend to create uneven wear, i.e., if the groove wall surface inclination is greater than 14°, the optimum inclination of surface 16 would be greater than 55°, whereas if the inclination of the groove walls in question is less than 14°, the optimum inclination of surface 16 will be less than 55°. In each case, compensating surface 16 will be inclined in the same direction as the groove walls which create the uneven wear of diamond nib 6.

The minimum value of 1 ° for the inclination of the groove walls is cited because, at least with the type of machine equipment contemplated, this is the minimum angle which can be cut. At angles greater than 20°, uneven wear of nib 6 is compensated to a substantial degree by the wear experienced when cutting the groove corners, groove bottoms and land tops.

If both groove walls should be inclined at an angle of 20° or less, then, according to the invention, a second unused portion could be created at the left-hand portion of wheel 2 and holder 4 could be driven to cause nib 6 to form a surface similar to surface 16 but inclined in the opposite direction during each dressing pass.

As noted above, the right-hand extremity of region 12 is constituted by a groove wall portion which extends at a small angle to a plane perpendicular to the axis of wheel rotation. Because of the small extent of this groove wall portion and the compensating effect on the nib of the large radius at the groove bottom adjacent that wall portion, it has been found that formation of that wall portion will not have a noticeable effect on the contour of nib 6. If this were not the case, the uneven wear caused by that wall portion could be compensated in the manner described above.

The invention has been carried out using a model 87R grinder marketed by the S. E. Huffman Company, equipped with a 90 Flieson ( TM ) diamond nib marketed by the Winter Diamond Company. This nib initially has a diameter of 0.6 mm (0.024") and the profile which was cut had the angular dimensions indicated in the Figure and minimum radiuses at the corners of the groove bottoms of the order of 0.8 mm (0.031").

The model 87R grinder is equipped with a numerical control system provided with the Apt software program, which enables the machine to be programmed to create any desired grinding wheel profile.

While the above description refers to a compensating surface in the form of a conic section having linear generatrices, the invention contemplates the formation of surfaces having arcuate generatrices selected to produce the desired wear compensation. The essential requirement is that the overall inclination of the compensating surface be such as to eliminate the sharp point which tends to be formed at the leading edge of the contour of nib 6 as a result of extensive dressing of groove walls having an inclination of 20° or less.

While the diamond nib employed thus far in the practice of the invention was of a type which initially had a circular cross section, the invention could be applied to diamond nibs having other cross-sectional configurations.

While the description above shows particular embodiments of the present invention, it will be understood that many modifications may be made without departing from the spirit thereof. The pending claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a method for dressing a grinding wheel by advancing a diamond nib adjacent the outer circumference of the wheel while the wheel rotates about its axis, which method includes causing the diamond nib to execute a plurality of passes in a direction parallel to the axis of wheel rotation while displacing the nib perpendicular to the axis of wheel rotation in a pattern corresponding to the profile to be created at the wheel circumference, which profile includes at least one annular groove having at least one side wall which extends in a given angular direction at an angle of no greater than 20, to a plane perpendicular to the axis of wheel rotation, the improvement comprising providing the wheel with a circumferential portion which will not be used for a subsequent grinding operation and forming, by means of the nib, an inclined surface on said circumferential portion which extends in the given angular direction at an angle to a plane perpendicular to the axis of wheel rotation which is greater than the angle of said at least one groove wall in order to create an even wear of the nib.

2. A method as defined in claim 1 wherein the profile includes a plurality of annular grooves each having at least one side wall which extends in the given angular direction at an angle of no greater than 20° to a plane perpendicular to the axis of wheel rotation.

3. A method as defined in claim 2 wherein the inclined surface on the circumferential portion is formed adjacent an axial end face of the grinding wheel.

4. A method as defined in claim 3 wherein the inclined surface has an inclination of 30°-60° to a plane perpendicular to the axis of wheel rotation.

5. A method as defined in claim 4 wherein the angle of inclination is of the order of 55°.

6. A method as defined in claim 3 wherein the diamond nib initially has a circular cross section.

7. A method as defined in claim 3 wherein the inclined surface has the form of a conic section with linear generatrices.

8. A method as defined in claim 1 wherein the inclined surface has an inclination of 30°-60° to a plane perpendicular to the axis of wheel rotation.

9. A method as defined in claim 8 wherein the angle of inclination is of the order of 55°.

10. A method as defined in claim 1 wherein the diamond nib initially has a circular cross section.

11. A method as defined in claim 1 wherein the inclined surface has the form of a conic section with linear generatrices.

* * * * *